US008733912B2

(12) United States Patent
Kimura

(10) Patent No.: US 8,733,912 B2
(45) Date of Patent: May 27, 2014

(54) LIQUID CONTAINER

(71) Applicant: Seiko Epson Corporation, Tokyo (JP)

(72) Inventor: Hitotoshi Kimura, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/713,458

(22) Filed: Dec. 13, 2012

(65) Prior Publication Data

US 2013/0100214 A1 Apr. 25, 2013

Related U.S. Application Data

(60) Continuation of application No. 13/358,730, filed on Jan. 26, 2012, now Pat. No. 8,353,583, which is a division of application No. 12/388,276, filed on Feb. 18, 2009, now Pat. No. 8,123,341.

(30) Foreign Application Priority Data

Feb. 20, 2008 (JP) ..... 2008-038360
Feb. 9, 2009 (JP) ..... 2009-027251

(51) Int. Cl.
*B41J 2/175* (2006.01)

(52) U.S. Cl.
USPC ..... 347/86; 347/85

(58) Field of Classification Search
USPC ..... 347/85, 86
See application file for complete search history.

(56) References Cited

U.S. PATENT DOCUMENTS

| | | | |
|---|---|---|---|
| 6,220,702 | B1 | 4/2001 | Nakamura et al. |
| 7,677,712 | B2 | 3/2010 | Ishizawa et al. |
| 2008/0037910 | A1 | 2/2008 | Matsumoto |
| 2008/0137998 | A1 | 6/2008 | Burfiend et al. |

FOREIGN PATENT DOCUMENTS

| | | | |
|---|---|---|---|
| EP | 1 013 449 | A2 | 6/2000 |
| JP | 2000-238291 | A | 9/2000 |
| JP | 2002-361882 | A | 12/2002 |
| JP | 2005-186479 | A | 7/2005 |
| JP | 2005-254570 | A | 9/2005 |
| JP | 2007-290388 | A | 11/2007 |

*Primary Examiner* — Lisa M Solomon

(57) ABSTRACT

A liquid container comprises a liquid container pouch of flexible sheets and a liquid outlet between the pair of flexible sheets to permit extraction of a liquid in the pouch. The pouch includes a pair of side portions and a lower gusseted portion defining a basal gusset and including bilateral edge portions overlapping individual lower border zones on the side constituting the lower borders of the pair of side portions during extraction of liquid. The individual lower border zones and the individual bilateral side edge portions overlap to define sealed portions; the lower gusseted portion has a fold line parallel to the lower border between the bilateral edge portions and is oriented in a folding direction to define a chevron shape pointing inwardly into the pouch; and the two sealed portions having regulators to restrain outward expansion by a greater extent than other faces on the pair of side portions.

16 Claims, 8 Drawing Sheets

LIQUID CONTAINER

CROSS REFERENCE TO RELATED APPLICATIONS

This application is a continuation of, and claims priority under 35 U.S.C. §120 on, U.S. application Ser. No. 13/358,730, filed on Jan. 26, 2012, which is a division of, and claims priority under 35 U.S.C. §120 on, U.S. application Ser. No. 12/388,276, filed on Feb. 18, 2009, now U.S. Pat. No. 8,123,341, issued Feb. 28, 2012, which claims priority under 35 U.S.C. §119 on Japanese Patent Application Nos. 2008-38360 and 2009-027251, filed on Feb. 20, 2008 and Feb. 9, 2009, respectively. The content of each such related application is incorporated by reference herein in its entirety.

BACKGROUND

1. Technical Field

The present invention relates to a liquid container made of flexible sheets adapted to internally store a liquid for supply to a liquid consuming apparatus.

The invention relates primarily to a liquid container suitable as an ink pack for internally storing ink that is to be supplied to an ink-jet printer as the liquid consuming apparatus.

2. Description of the Related Art

Ink packs designed to internally store ink to be supplied to an ink-jet printer, and composed of flexible sheets having liquid outlet member (22) for feeding the ink to the ink-jet printer are known in the art (see Patent Citation 1 for example).

This kind of ink pack has a pair of side wall portions disposed facing one another, and a gusseted portion that defines a gusset between the pair of side wall portions.

In an ink pack of this type, the gusseted portion progressively folds in jackknife fashion as the ink inside is consumed; if during this process the fold line jackknifes in such a way as to protrude outward, there will be considerable resistance to folding, resulting in a larger amount of ink that is not ultimately consumed but instead remains left in the ink pack.

Particularly where an ink pack is designed with a gusseted portion situated at the bottom, the fold line of the gusseted portion will tend to protrude outward (downward) due to the weight of the ink.

According to the teachings of Patent Citation 1, a regulating member (17) adapted to regulate the folding face from bending outwardly is provided inside the case which houses the ink pack.

However, the teachings of Patent Citation 1 require provision of the regulating member, which is inherently superfluous in terms of ink delivery. Moreover, it is not a simple matter to accommodate both the regulating member and the ink pack within the case.

Furthermore, because in the initial state the regulating member inwardly indents the gusseted portion, the amount of ink filling the ink pack will be smaller.

Another known conventional ink pack is provided with regulating plates (11) designed to regulate collapse of the pack in a uniform manner as the ink is consumed (Patent Citations 2, FIG. 3).

An ink pouch of so-called gusset type embodying this teaching is depicted in model cross section in FIGS. 9A-D. In the drawing, regulating plates 2 are shown applied to the side faces of a pack (flexible pouch) 1 composed of flexible sheeting.

FIG. 9A depicts a condition in which the pack 1 has been filled with a relatively small amount of ink. In this condition, due to the low weight of the ink inside the pack, the gusseted portion 3 that constitutes the base part will maintain chevron shape with the fold line 3*a* as the apical line.

Consequently, as the ink inside the pack is consumed, the ink pack 1 will collapse in such a way that the gusseted portion 3 progressively folds inward as depicted in FIG. 9B. This is the preferred condition, as the amount of residual ink left inside the pack 1 will be minimized.

FIG. 9C on the other hand depicts a condition in which the pack 1 has been filled with a relatively large amount of ink. In this condition, due to the heavy weight of the ink inside the pack, in the gusseted portion 3 that constitutes the base part of the pack 1, the bottom will distend downwardly so that the fold line 3*a* forms a downwardly pendant valley part.

Thus, as the ink inside the pack is consumed, the gusseted portion 3 will fold up with its fold line 3*a* protruding downward as depicted in FIG. 9D. This is an undesirable condition, as a large amount of residual ink will be left inside the pack 1. Such a condition can easily occur if the ink pack is left at high temperature when first used.

Thus, according to the teachings of Patent Citation 2, if the ink pack is filled with a large amount of ink to the point that the gusseted portion distends outwardly, the problem of a considerable amount of ink being left behind at completion of use of the ink pack will arise.

[Patent Citation 1] Japanese Unexamined Patent Publication 2005-254570

[Patent Citation 1] Japanese Unexamined Patent Publication 2002-361882

SUMMARY

It is accordingly one object of the present invention to address the above issues and provide a liquid container that minimizes the amount of liquid left behind at completion of use, even if filled with a large quantity of liquid.

The liquid container according to a first aspect of the present invention for attaining the stated object has a liquid container pouch of pouch form constructed of flexible sheets; and a liquid outlet member held between the pair of flexible sheets to permit extraction of a liquid contained in the liquid container pouch to a liquid consuming apparatus;

wherein the liquid container pouch includes:

a pair of side portions; and a lower gusseted portion that defines a basal gusset and that includes first bilateral edge portions disposed overlapping individual lower border zones that are situated on the side constituting the lower borders of the pair of side portions during extraction of liquid for use by the liquid consuming apparatus;

the individual lower border zones of the pair of side portions and the individual bilateral first side edge portions of the lower gusseted portion respectively overlap to define two first sealed portions;

the lower gusseted portion has a first fold line extending parallel to the lower border between the first bilateral edge portions and is oriented in a folding direction so as to define a chevron shape pointing inwardly into the liquid container pouch, with the first fold line as the apical line thereof; and the two first sealed portions are furnished with regulating members adapted to restrain outward expansion thereof by a greater extent than faces other than the two first sealed portions on the pair of side portions.

According to this liquid container, regulating members will prevent first sealed portions that are situated to the lower border side of the side wall portions from expanding outward beyond portions of the side wall portions other than the first sealed portions. Thus, with the bilateral edge portions of the lower gusseted portion as support points, moment will act in such a way as to induce folding of the lower gusseted portion into a chevron shape pointing inwardly into the liquid container pouch and having the first fold line as the apical line thereof.

This action of moment occurs even where the liquid container pouch has been filled with a large quantity of liquid, with the action continuing uninterrupted until service is complete at the point that the liquid in the liquid container pouch has been totally consumed.

Thus, even if this liquid container has been filled with a large quantity of liquid, the lower gusseted portion will fold up correctly under the action of the aforementioned moment as the liquid is progressively consumed. Consequently, this liquid container affords the advantage that even if filled with a large quantity of liquid, the amount of remaining liquid at completion of use can be minimized.

Moreover, the need to provide the case with a regulating member separate from the liquid container, as taught in Patent Citation 1, is obviated.

In the liquid container according to the first aspect of the present invention, it is possible for the regulating member to be composed of two plate-like members of higher rigidity than the flexible sheets, adhered overlapping at least individual parts of the two first sealed portions at the individual outside faces of the pair of side portions.

By so doing, the lower gusseted portion can be induced to fold up correctly through a simple construction.

In another possible mode of the liquid container according to the present invention, the liquid container has an upper gusseted portion that defines an apical gusset and that includes second bilateral edge portions disposed overlapping individual upper border zones that are situated on the side constituting the upper borders of the pair of side portions during extraction of liquid for use by the liquid consuming apparatus; the upper gusseted portion has a second fold line extending parallel to the upper border in the center between the second bilateral edge portions and is oriented in a folding direction so as to define a chevron shape pointing inwardly into the liquid container pouch, with the second fold line as the apical line thereof; and the upper edges of the plate-like members are situated in proximity to the heightwise location of the second fold line when the upper gusseted portion assumes the folded state.

With this arrangement, the liquid capacity can be increased commensurately with the provision of the upper gusseted portion. Compare this to the case where the upper gusseted portion is provided, but the upper edges of the plate-like members are situated above the location of the second fold line when the upper gusseted portion assumes the folded state. In this case, as the liquid is progressively consumed, if for some reason the gap between the plate-like members should become too small before the upper gusseted portion folds inward (downward), there is a risk that the upper gusseted portion will have difficulty folding inward (downward). This risk can be eliminated by situating the upper edges of the plate-like members in proximity to the heightwise location of the second fold line when the upper gusseted portion assumes the folded state as described above.

Compare this to the case where the upper edges of the plate-like members are situated above the location of the second fold line when the upper gusseted portion assumes the folded state. In this case, in the upper part of the side wall portions the zones not provided with the plate-like members will be larger, and as the liquid is progressively consumed, the side wall portions in these zones may assume an unstable condition which possibly results in wrinkles or the like, posing a risk of an increased amount of liquid remaining at completion of use.

On the other hand, by situating the upper edges of the plate-like members in proximity to the heightwise location of the second fold line when the upper gusseted portion assumes the folded state as described above, this risk can be eliminated.

Moreover, in this case, during filling, the side wall portions to the upper side from the plate-like members are able to distend outwardly, thus providing commensurate increase in liquid capacity. In the liquid container according to the present invention, the upper edges of the plate-like members can be established at locations overlapping at least individual parts of the two first sealed portions.

This arrangement makes it easier for the upper gusseted portion to fold up correctly, while at the same because the side wall portions are supported across their entire vertical extension by the plate-like members, wrinkles etc. are not likely to occur so that the amount of liquid remaining at completion of use can be reduced.

In the liquid container according to the first aspect of the present invention, the liquid container pouch may include a front border sealed portion in which the liquid outlet member is installed; and a rear border sealed portion extending along a border to the opposite side from the front border sealed portion; with the liquid container pouch in the filled state, each of the pair of side wall portions may include, in a direction parallel to the upper border, a front side sloping portion that slopes and extends out beyond the front border seal, a rear side sloping portion that slopes and extends out beyond the rear border seal, and a flat portion situated between the front and rear sloping portions; and the two plate-like members may be respectively disposed in the flat portions in the pair of side wall portions.

With this arrangement, during filling of the liquid container pouch with liquid, the liquid container pouch can distend in a satisfactory manner according to the amount of liquid, despite the presence of the plate-like members.

A second aspect of the present invention provides a liquid container attachable to a liquid consuming apparatus. The liquid container pertaining to the second aspect comprises a supplying portion, a containing portion and a first rigid member. The supplying portion has a supplying opening and supplies a liquid to the liquid consuming apparatus in a state that the liquid container is attached to the liquid consuming apparatus. The containing portion is connected to the supplying portion, the containing portion containing the liquid, the containing portion being made of a flexible sheet material. The containing portion has a first side portion, a bottom portion positioned at a bottom of the containing portion in a state that the liquid container is attached to the liquid consuming apparatus and a first bottom-side sealed portion formed by joining edge portions of the first side portion and the bottom portion. The first rigid member is arranged along the first side portion and over an upper end of the first bottom-side sealed portion. The first rigid member is made of a material of higher rigidity than the flexible sheet material, whereby the first rigid member restricts displacement of the first bottom-side sealed portion in a lateral direction. In this case, moment acts in such a way as the bottom portion is headed to upward, i.e. inward of the containing portion.

Therefore, when the remaining liquid in the containing portion is low, it may restrict the possibility of the bottom portion to move downward, i.e. outward of the containing portion. As a result, the amount of remaining liquid in the containing portion at completion of use may be minimized.

The above and other objects, characterizing features, aspects and advantages of the present invention will be clear from the description of preferred embodiments presented below along with the attached figures.

DETAILED DESCRIPTION OF THE PREFERRED EMBODIMENTS

The preferred embodiments of the liquid pack according to the present invention will be described below with reference to the accompanying drawings. The embodiments described herein should not be construed as unduly limiting the present invention set forth in the appended claims, and not all of the arrangements described hereinbelow are essential as means for solving the problem of the invention.

Embodiments

Figure 1A:
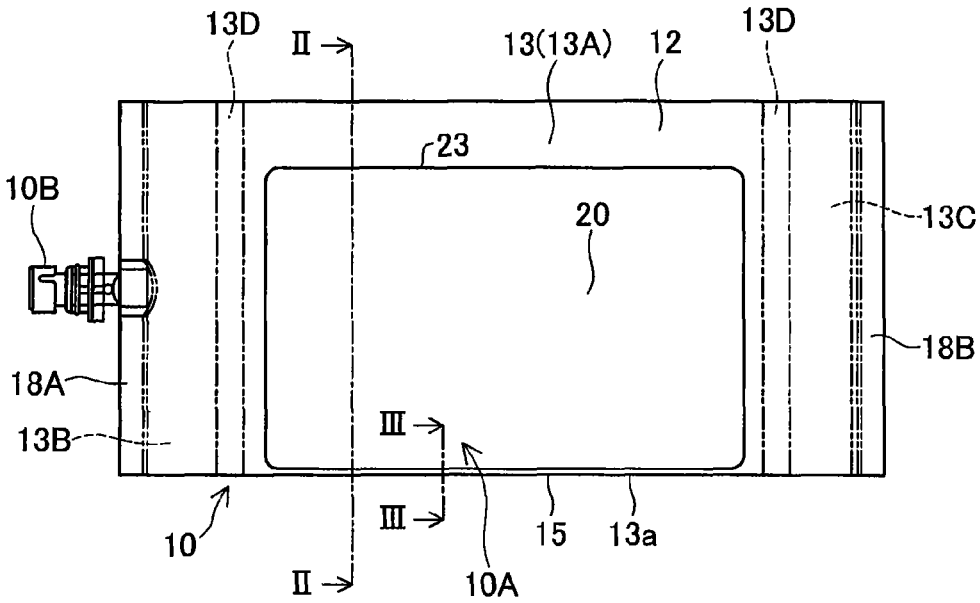
FIGS. 1A-C illustrate a liquid pack shown by way of an embodiment of the liquid container according to the present invention.
Figure 1B:
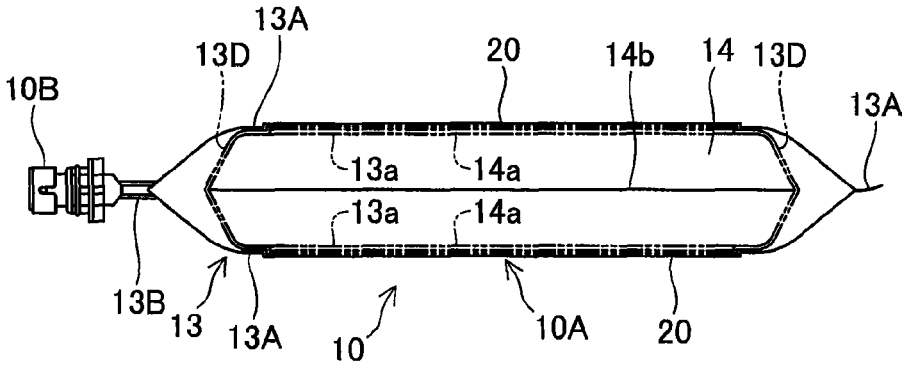
Figure 1C:
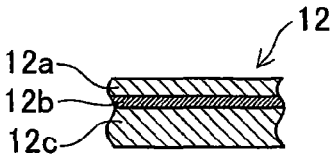
Figure 2A:
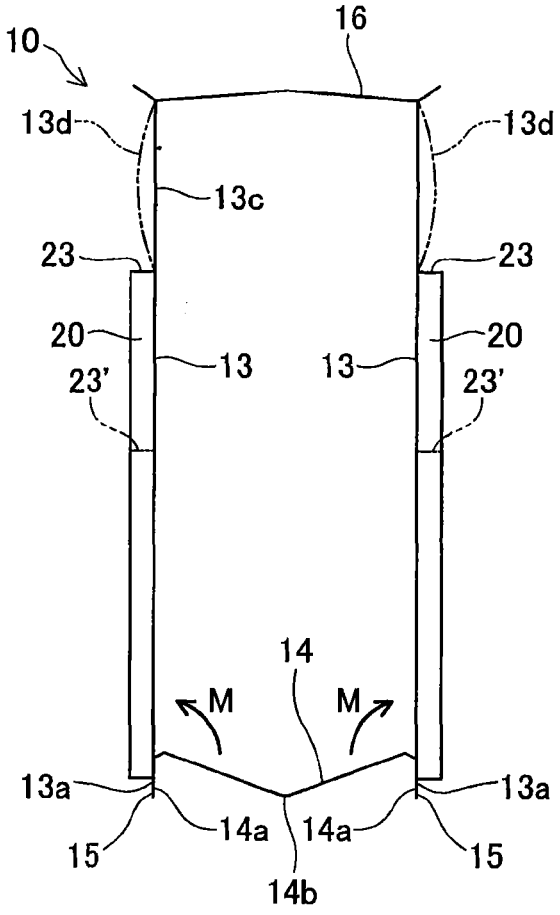
FIGS. 2A-B represent in model form the II-II cross section in FIG. 1A.
Figure 2B:
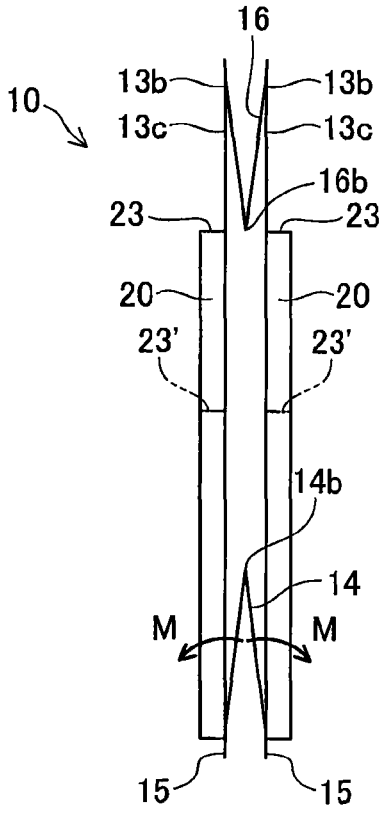

FIGS. 1A-C illustrate a liquid pack shown by way of an embodiment of the liquid container according to the present invention. FIG. 1A is a front view, FIG. 1B is a bottom view, and FIG. 1C is a sectional view depicting the layer structure of the flexible sheet. FIGS. 2A-B represent in model form the II-II cross section in FIG. 1A. FIG. 2A depicts a liquid container pouch 10A in cross section when filled to full with liquid; and FIG. 2B depicts the liquid container pouch 10A in cross section with some liquid remaining.

As depicted in FIGS. 1A-C and in FIGS. 2A-B, this liquid pack 10 has a liquid container pouch 10A of pouch form made of flexible sheets 12; and a liquid outlet member 10B retained between the pair of flexible sheets and used for drawing out liquid contained in the liquid container pouch 10A to a liquid consuming apparatus such as a printer. FIG. 1A depicts the liquid pack 10 being used in a condition set up in a liquid consuming apparatus so that liquid may be drawn out from it. In the following description, the vertical direction coincides with the vertical direction in the condition of use depicted in FIG. 1A.

The liquid pack 10 of the present embodiment is an ink pack designed to internally store ink for supply to an ink-jet printer as the liquid consuming apparatus.

As shown in FIGS. 2A-B, this liquid pack 10 includes a pair of side wall portions 13, 13 disposed in opposition to one another; and a lower gusseted portion 14 that defines a basal gusset and that includes first bilateral edge portions 14*a*, 14*a* disposed overlapping individual lower border zones 13*a*, 13*a* that are intended to be oriented towards the side constituting the lower borders of the pair of side portions 13, 13 when liquid is being extracted for use by the liquid consuming apparatus.

As depicted in FIGS. 2A-B, the individual lower border zones 13*a*, 13*a* of the pair of side wall portions 13, 13 and the first bilateral edge portions 14*a*, 14*a* of the lower gusseted portion 14 are respectively overlapped and heat bonded to one another to produce two first sealed portions 15, 15.

As shown in FIGS. 2A-B, the lower gusseted portion 14 has a first fold line 14*b* extending parallel to the lower border through the center between the first bilateral edge portions 14*a*, 14*a*; and as shown in FIG. 2B is oriented in a folding direction so as to define a chevron shape that points inwardly into the liquid container pouch, with the first fold line 14*b* as the apical line.

As depicted in FIGS. 2A-B, this liquid pack 10 has regulating members 20 adapted to restrain the two first sealed portions 15, 15 from outward expansion by a greater extent than faces other than these two first sealed portions 15, 15 on the pair of side portions 13, 13.

In the present embodiment, an upper gusseted portion 16 that defines an apical gusset may be provided in addition to the lower gusseted portion 14 that defines the basal gusset.

As depicted in FIG. 1A, the flexible sheet 12 is a sheet having, for example, a triple-layer structure wherein the three layers are composed of an outer layer 12*a* of PET, nylon or other material with excellent impact resistance; a middle layer 12*b* of aluminum or other material with excellent gas barrier properties; and an inner layer 12*c* of polyethylene or other material with excellent heat bondability.

The liquid container pouch 10A that makes up the liquid pack 10 is constituted as a pouch of gusset type, produced by positioning a pair of the aforementioned flexible sheets 12 that constitute the pair of side wall portions 13, with their inner layers 12*c* facing each other, positioning the upper gusseted portion 16 and the lower gusseted portion 14, which are composed of the aforementioned flexible sheets 12 at top and bottom of the side wall portions 13, so that their inner layers 12*c* face each other, and then heat sealing the juxtaposed faces. The pair of side wall portions 13 are then heat sealed at one border with the liquid outlet member 10B arranged between the pair of side wall portions 13, thereby unifying the liquid outlet member 10B with the liquid container pouch 10A.

Figure 3A:
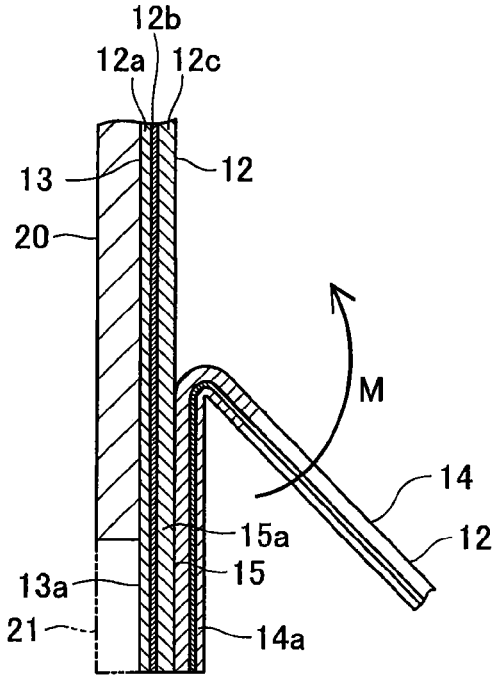
FIGS. 3A-C are enlarged sectional views taken along III-III in FIG. 1A.
Figure 3B:
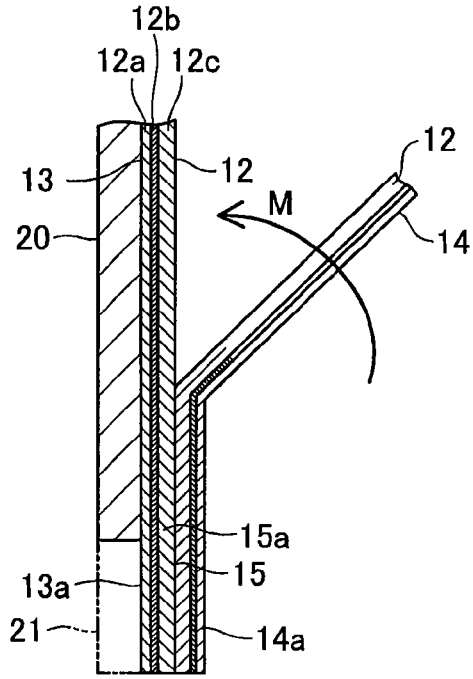
Figure 3C:
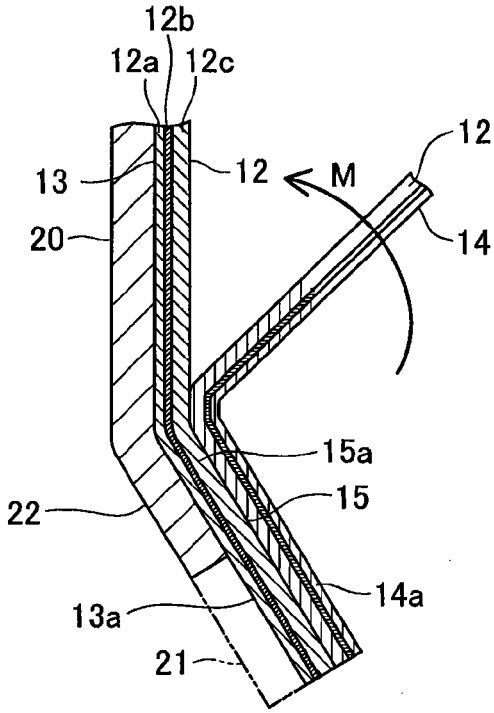

FIGS. 3A-C are enlarged sectional views taken along III-III in FIG. 1A. FIG. 3A depicts the liquid container pouch 10A in cross section when filled to full with liquid; and FIG. 3B depicts the liquid container pouch 10A in cross section with some liquid remaining.

As shown in FIGS. 2A-B and FIGS. 3A-B, the regulating members 20 are composed of two plate-like members of higher rigidity than the flexible sheets 12, which are overlapped and adhered to individual parts of the two first sealed portions 13 on the individual outside surfaces of the pair of side wall portions 13.

According to this liquid pack 10, the plate-like members 20 that serve as the regulating members function to restrain the two first sealed portions 15, 15 from outward expansion by a greater extent than faces other than the first sealed portions 15, 15 on the pair of side portions 13, 13.

Thus, as shown in FIGS. 2A-B and FIGS. 3A-B, with the sealed portions 15 and the lower border zones 13*a* of the lower gusseted portion 14 as support points, moment M will act in such a way as to induce folding of the lower gusseted portion 14 into a chevron shape that points inwardly into the liquid pack 10, with the fold line 14*b* as its apical line.

As depicted in FIG. 2A and FIG. 3A, such action of moment will occur where the pack 10 has been filled with a large quantity of liquid; and this action will continue uninterrupted until use is completed at the point that the liquid in pack 10 has been consumed, as depicted in FIG. 2B and FIG. 3B.

Thus, even if this liquid pack 10 is filled with a large quantity of liquid as depicted in FIG. 2A, the lower gusseted portion 14 will fold up correctly under the action of the aforementioned moment M as the liquid is progressively consumed, as depicted in FIG. 2B.

Consequently, the liquid pack 10 affords the advantage that even when it is filled with a large quantity of liquid, the amount of remaining liquid at completion of use can be minimized.

Another advantage is that the need to provide a separate member that inserts into the lower gusseted portion of the pack, as seen in prior art Patent Citation 1, is obviated.

Figure 5:
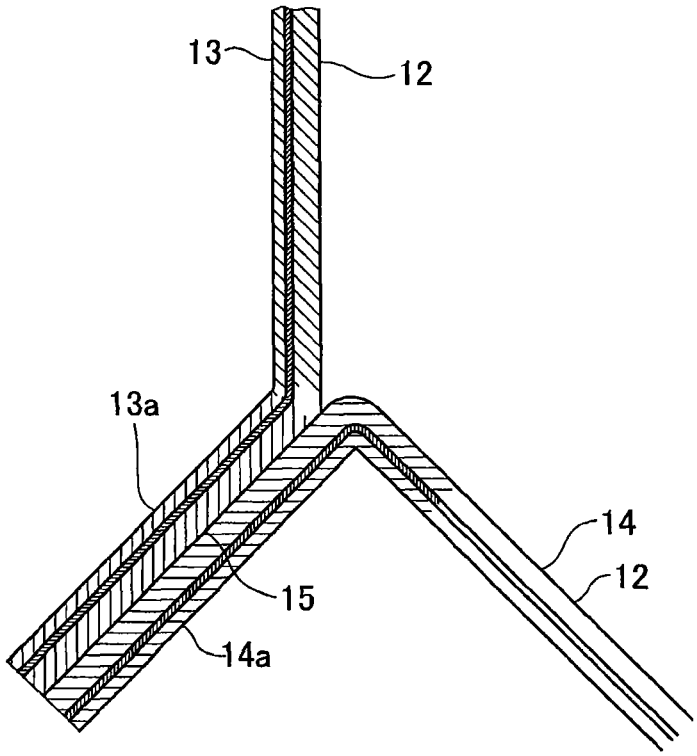
FIG. 5 is an illustration depicting a comparative example, and corresponds to an enlarged sectional view taken along III-III in FIG. 1A.

FIG. 5 is an illustration depicting a comparative example, and corresponds to an enlarged sectional view taken along III-III in FIG. 1A. In this comparative example, the aforementioned plate-like member 20 is disposed so as to extend up to the sealed portion 15.

Thus, if the pack of the comparative example is filled with a large quantity of liquid, the sealed portion 15 will open towards the outside as depicted in FIG. 5, and there will be substantially no action of moment M maintaining the lower gusseted portion 14 in chevron shape with the fold line 14*b* as its apical line; or if there is such action, the magnitude thereof will be exceedingly small.

Figure 9A:
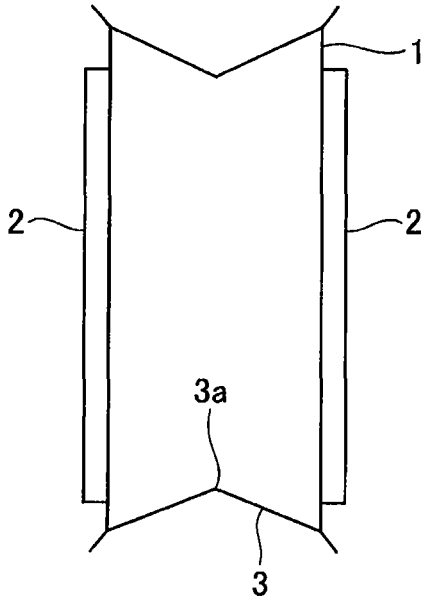
FIGS. 9A-D are illustrations for explaining the problem of the conventional technique.
Figure 9B:
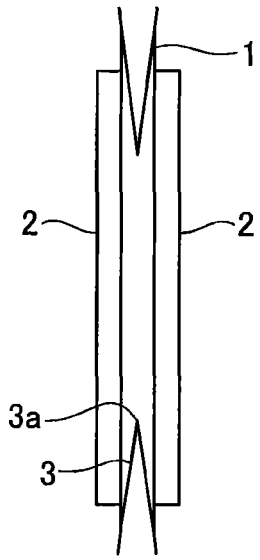
Figure 9C:
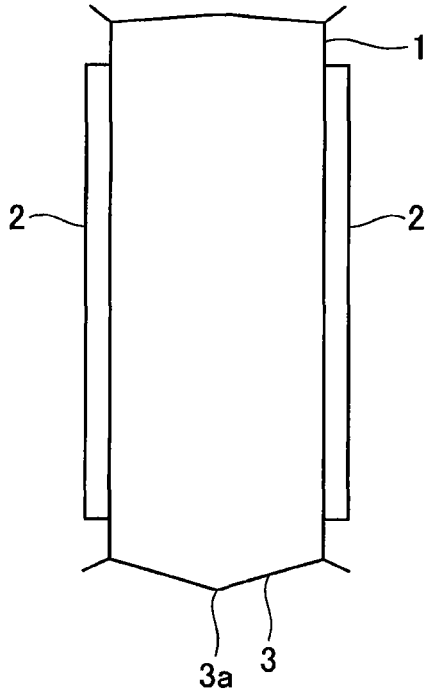
Figure 9D:
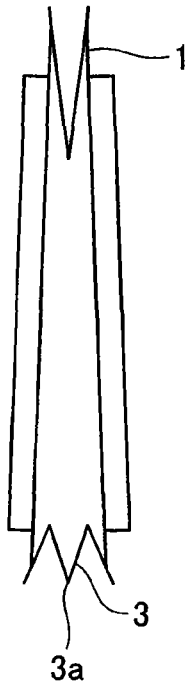

For this reason, as depicted in FIG. 9D, as the ink inside the pack is progressively consumed, the lower gusseted portion will fold up with its fold line protruding downward, and a considerable amount of ink will be left in the pack.

With the liquid pack 10 of the present embodiment on the other hand, the lower gusseted portion 14 will fold correctly so that remaining ink can be minimized.

Since the regulating member 20 is constituted as a plate-like member of greater rigidity than the flexible sheet 12 that is produced by overlapping and adhering to part 15*a* of the sealed portion 15, the sealed portion 15 can be regulated through a simple arrangement.

The plate-like member 20 may also be disposed overlapping the sealed portion 15 down to the lower edge as depicted by a hypothetical line 21 in FIG. 3A.

By so doing, stronger moment M can be achieved in a reliable manner.

The plate-like members 20 may also be bent inwardly at the bottom end 22, as in a modified example depicted in FIG. 3C. In this case as well, the plate-like member 20 may be disposed overlapping the sealed portion 15 down to the lower edge as depicted by a hypothetical line 21 in FIG. 3C.

With this arrangement, not only will the sealed portion 15 be restrained from outward expansion to a greater extent than the side wall portion 30, but the sealed portion 15 20 will be restrained at an inward location by the inwardly bent lower end 22 of the plate-like member 20. By so doing, stronger moment M can be achieved in a reliable manner.

In the preceding embodiment, as depicted in FIG. 2B, between upper border zones on the upper border side of the pair of side wall portions 13, the upper gusseted portion 16 is disposed so as to have symmetrical shape with the lower gusseted portion 14 in relation to the vertical direction. By so doing, liquid capacity can be increased commensurately with the provision of the upper gusseted portion 16.

The cross sectional structure of the upper gusseted portion 16 is identical to that of the lower gusseted portion 14 and as such is omitted from the illustration; however, the liquid pack 10A herein has an upper gusseted portion 16 that defines an apical gusset and that includes second bilateral edge portions disposed overlapping the individual upper border zones 13*b* that are situated on the side constituting the upper borders of the pair of side portions 13, 13 during extraction of liquid for use by the liquid consuming apparatus. As depicted in FIG. 2B, like the lower gusseted portion 14, the upper gusseted portion 16 has a second fold line 16*b* that extends parallel to the upper border in the center between the second bilateral edge portions, and is oriented in a folding direction so as to define a chevron shape pointing inwardly into the liquid container pouch 10A, with the second fold line 16*b* as its apical line.

In the present embodiment, the upper edges 23 of the plate-like members 20 will be situated in proximity to the heightwise location of the second fold line 16*b* when the upper gusseted portion 16 has assumed the folded state, as depicted in FIG. 2B.

Where the upper gusseted portion 16 has been provided, but in contrast to FIG. 2B, the upper edges 23 of the plate-like members 20 are situated above the aforementioned location (the location depicted in FIG. 2B) (see FIG. 4B), there is a risk that as the liquid is progressively consumed, for some reason the gap between the plate-like members 20 may become too small before the upper gusseted portion 16 has folded inward (downward). If this should occur, the upper gusseted portion 16 will have difficulty folding inward (downward).

In contrast, where the upper edges 23 of the plate-like members 20 are situated at locations in proximity in the vertical direction to the fold line 16*b* when the upper gusseted portion 16 has assumed the folded state, this risk will be eliminated.

Where on the other hand the edges 23' of the plate-like members 20 are situated below the location of the fold line 16*b* when the upper gusseted portion 16 has assumed the folded state, as depicted by the hypothetical lines 23' in FIGS. 2A-B, there is a risk of a problem occurring. Specifically, in the upper part of the side wall portions the zones 13*c* not provided with the plate-like members 20 will be larger, and thus as liquid is progressively consumed, the side wall portions in these zones 13*c* may assume an unstable condition possibly resulting in wrinkles or the like, posing a risk of an increased amount of liquid remaining at completion of use.

In contrast, where the upper edges 23 of the plate-like members 20 are situated at locations in proximity to the fold line 16*b* when the upper gusseted portion 16 has assumed the folded state as depicted in FIG. 2B, this risk will be eliminated.

Moreover, where the upper edges 23 of the plate-like members 20 are situated at locations in proximity to the fold line 16*b* when the upper gusseted portion 16 has assumed the folded state, the side wall portions 13*c* above the upper edges 23 will be able to distend outwardly during filling as depicted by the hypothetical lines 13*d* in FIG. 2A, thus providing commensurate increase in liquid capacity.

Figure 4A:
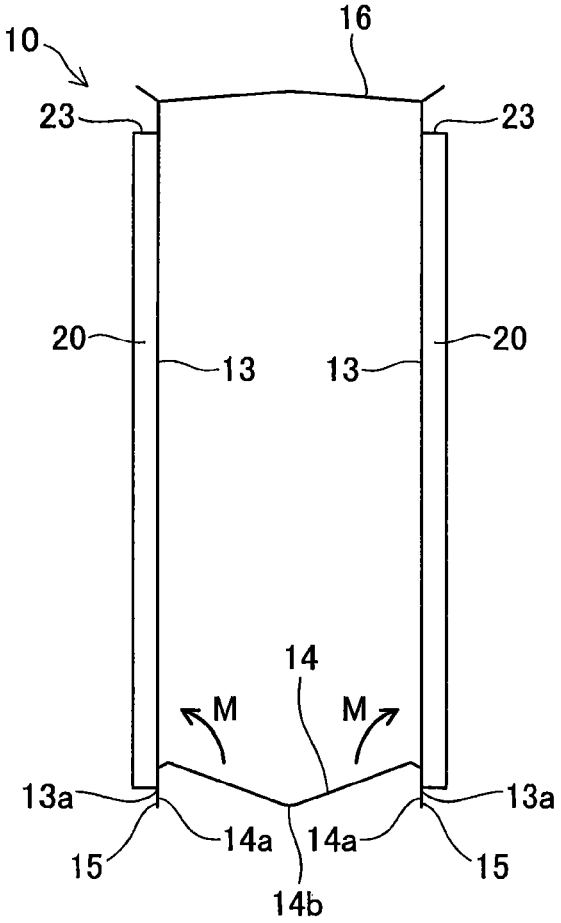
FIGS. 4A-B show variations of upper portion of liquid pack 10.
Figure 4B:
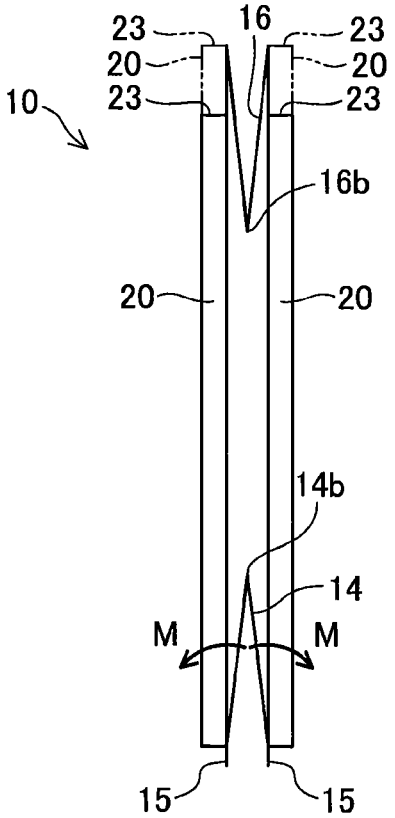

FIGS. 4A-B depicts a modified example of the upper part of the liquid pack 10. As shown in the drawings, the upper edges 23 of the plate-like members 20 may be situated at locations above the lower edge 16*b* when the upper gusseted portion 16 has assumed the folded state.

If this arrangement is employed, as discussed previously there will be a risk that as the liquid is progressively consumed, if for some reason the gap between the plate-like members 20 should become too small before the upper gusseted portion 16 has folded inward (downward), the upper gusseted portion 16 will have difficulty folding inward (downward). However, under conditions of normal use, wrinkling etc. of the side wall portions 13 can be prevented, and the amount of liquid remaining at completion of use of the pack can be reduced.

As shown by the hypothetical lines 20, 23 in FIG. 4B, the upper edges 23 of the plate-like members 20 may be positioned at least partially overlapping the second sealed portions where the second bilateral edge portions of the upper gusseted portion 16 and the upper border zones 13*b* of the side wall portions 13 have been sealed together. The specific arrangement is substantially identical to turning FIG. 3 upside down, and thus will not be depicted herein.

This arrangement will facilitate correct folding up of the upper gusseted portion 16, while at the same time because the side wall portions 13 are supported across their entire vertical extension by the plate-like members 20, wrinkles etc. are not likely to occur so that the amount of liquid remaining in at completion of use of the pack can be reduced.

As depicted in FIG. 1, the lengthwise extension of the plate-like member 20 in relation to the direction of the aforementioned apical line 14*b* will lie within a flat portion 13A of the side wall portion 13.

Here, the liquid container pouch 10A has a front border sealed portion 18A in which the liquid outlet member 10B is installed, and a rear border sealed portion 18B extending along a border on the opposite side from the front border sealed portion. With the liquid container pouch 10A in the filled state, each of the pair of side wall portions 13, 13 will include, in a direction parallel to the upper border, a front side sloping portion 13B that slopes and extends out beyond the front border seal 18A, a rear side sloping portion 13C that slopes and extends out beyond the rear border seal 18B, and the aforementioned flat portion 13A, which is situated between the front and rear sloping portions 13B, 13C. The flat portion 13A connects at its two ends with the front and rear sloping portions 13B, 13C via curving portions 13D, 13D.

The two plate-like members 20, 20 are respectively situated in the flat portions 13A, 13A of the pair of side wall portions 13, 13. That is, the plate-like members 20 have length such that they do not reach the curving portions 13D contiguous with the side wall portions 13.

If the plate-like members 20 were of sufficient length to reach the curving portions 13D, there would be a risk of the plate-like members 20 hindering distension of the pack 10 when the pack 10 is being filled with liquid. In the present embodiment, the pack 10 can distend in a satisfactory manner when the pack 10 is being filled with liquid, despite the presence of the plate-like members 20.

Figure 6:
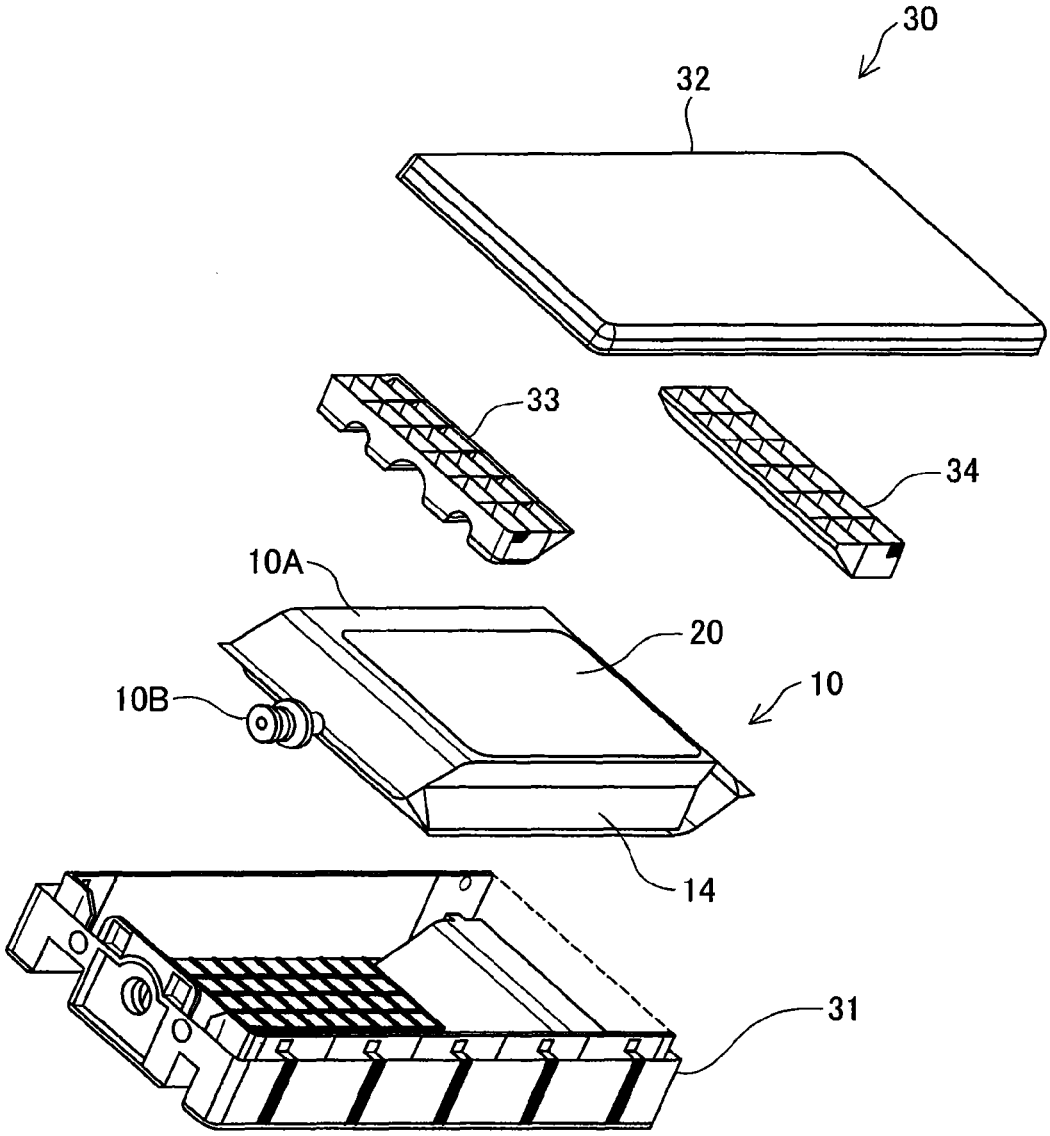
FIG. 6 is an exploded perspective view depicting an exemplary ink cartridge adapted to house the liquid pack.

FIG. 6 is an exploded perspective view depicting an exemplary ink cartridge adapted to house the liquid pack (ink pack).

While it is possible for the ink pack 10 to be used installed in an ink-jet printer in the condition illustrated in FIG. 1A, typically, it will be housed in an ink cartridge 30 as depicted in FIG. 30.

The ink cartridge 30 has a lower case 31 and an upper case 32, with the ink pack 10 housed inside a case assembled from the lower case 31 and the upper case 32.

33 and 34 are spacers that are respectively positioned in front and back of the ink pack 10; these function as restraining members for restraining the ink pack 10 inside the case.

Figure 7:
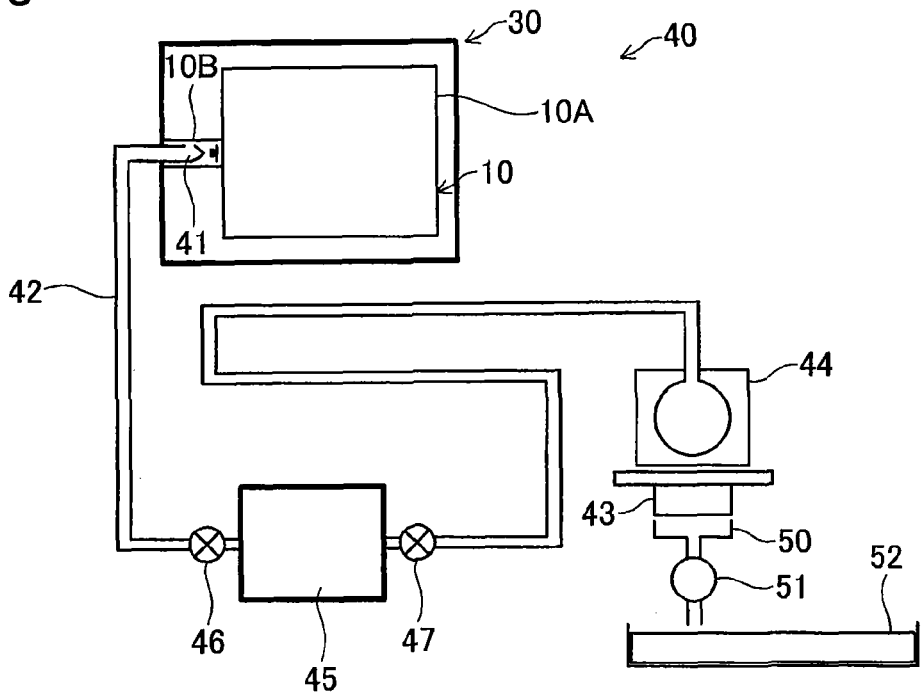
FIG. 7 is a schematic depicting a first example of an ink-jet printer that employs the ink cartridge 30 described above.

FIG. 7 is a schematic depicting a first example of an ink-jet printer that employs the ink cartridge 30 described above.

The ink cartridge 30 is installed in a cartridge installation section of a printer 40, and during the process an ink feed needle 41 provided to the printer 40 will insert into a feed port 11 of the ink pack 10.

The ink inside the ink pack 10 is fed from the ink feed needle 41 to a recording head (in-jet head) 43 through an ink feed line 42. The ink will be supplied from the ink pack 10 to the recording head 43 due to the hydraulic head difference between the ink pack 10 and the recording head 43.

As illustrated, a damper 44 is provided between the ink pack 10 and the recording head 43; however, in the absence of a pressure regulating valve (pressure reduction valve), it will be necessary to prevent the hydraulic head difference feed pressure from bearing directly on the recording head 43.

Accordingly, in this first example, a sub-tank (a flexible pouch of ink pack type) is provided to the ink feed line 42, a top-up valve 46 is provided on the upstream side thereof, and a feed valve 47 is provided on the downstream side thereof.

When ink is to be supplied from the ink pack 10 to the sub-tank, the top-up valve 46 will be opened (the feed valve 47 is closed).

Once top-up is complete, the top-up valve 46 is shut off, and the feed valve 478 is opened to feed ink to the recording head 43. That is, the sub-tank 45 functions as a kind of small-capacity ink cartridge.

Where such an arrangement is employed, the hydraulic head difference feed pressure can be prevented from bearing directly on the recording head 43, even in the absence of a pressure regulating valve (pressure reduction valve).

Additionally, 50 denotes a cap adapted to cover the nozzle face of the recording head 43 when the recording head 43 is positioned at the home position; 51 denotes a suction pump used to forcibly suction ink from the nozzles through the cap when the nozzles of the recording head 43 have become clogged, in order to eliminate the clog; and 52 denotes a waste ink absorber for absorbing waste ink from the suction pump 51.

Figure 8:
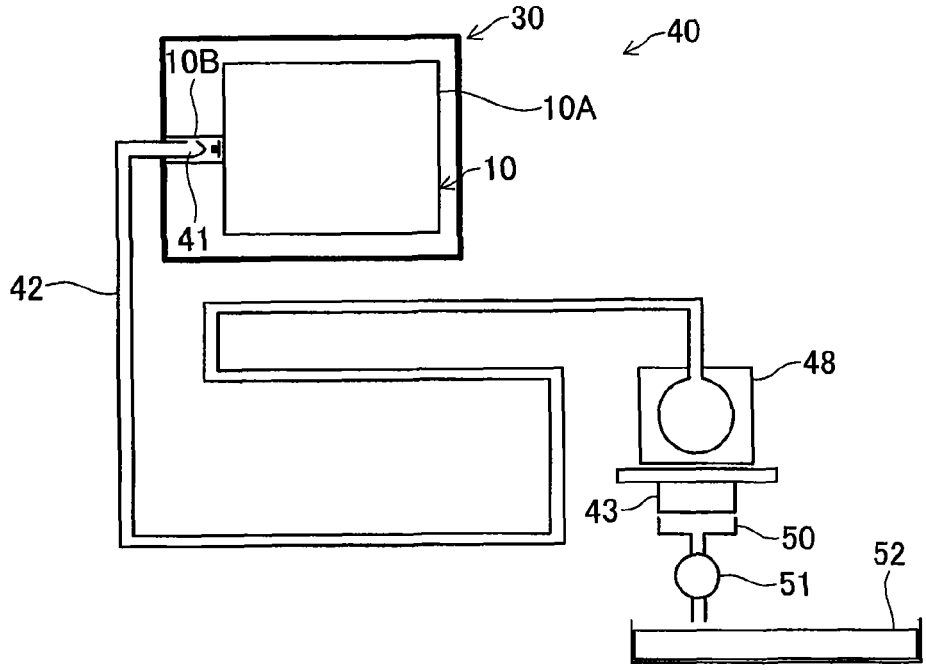
FIG. 8 is a schematic diagram depicting a second example of an ink-jet printer employing the aforementioned ink cartridge.

FIG. 8 is a schematic diagram depicting a second example of an ink-jet printer employing the aforementioned ink cartridge.

This second example differs from the preceding first example in that a pressure regulating valve (pressure reduction valve) 48 is provided between the ink pack 10 and the recording head 43, thereby preventing the hydraulic head difference feed pressure from bearing directly on the recording head 43, and rendering the sub-tank 45 and the aforementioned valves 46, 47 unnecessary.

However, there are no adverse effects of providing the sub-tank 45 and the valves 46, 47, and providing the sub-tank 45 means that the sub-tank 45 can be utilized for detecting remaining ink level.

While the preferred embodiment of has been described in detail herein, numerous variations will be readily apparent to the practitioner of the art without substantially departing from the novelty and effects of the present invention. Accordingly, such modified examples fall within the scope of the present invention. For example, terms appearing together with different terms of broader or identical meaning in the specification and drawings may be replaced with these different terms, at any point in the specification or drawings.

The present invention is not limited to application in ink cartridges for use in ink-jet recording devices, and may be adapted for use in liquid consuming apparatus of various kinds equipped with a liquid jetting head adapted to eject small amounts of a liquid in drop form. Herein, a drop refers to the state of the liquid as ejected from the liquid consuming apparatus, and includes those of granular, teardrop, or filiform shape having a tail.

Specific examples of such liquid consuming apparatus are, for example, a device equipped with a color matter jetting head, employed in manufacturing color filters for liquid crystal displays and the like; a device equipped with an electrode material (conductive paste) jetting head, employed for forming electrodes in organic EL displays, field emission displays (FED), and the like; a device equipped with a bioorganic substance jetting head, employed in biochip manufacture; a device equipped with a specimen jetting head as a precision pipette; textile printing devices; and microdispensers.

In the present invention, a liquid refers to any material that can be jetted from a liquid consuming apparatus. For example, substances of any state when in the liquid phase would be acceptable including those of a high- or low-viscosity liquid state, a sol, gel, water, or other inorganic solvent, organic solvent, solution, liquid resin, liquid metal (molten metal), or substances having the liquid state as one of their states; as well as materials containing solids such as pigments or metal particles dissolved, dispersed, or mixed into a medium. Typical examples of liquids are the inks described in the preceding embodiments; liquid crystals, and the like. Here, the term ink is used to include typical water based inks and oil based inks, as well as shellac, hot melt inks, and various other kinds of liquid compositions.

While the liquid container pertaining to the invention have been shown and described on the basis of the embodiment and variation, the embodiments of the invention described herein are merely intended to facilitate understanding of the invention, and implies no limitation thereof. Various modifications and improvements of the invention are possible without departing from the spirit and scope thereof as recited in the appended claims, and these will naturally be included as equivalents in the invention.

What is claimed is:

1. A liquid container attachable to a liquid consuming apparatus, the liquid container comprising:

a supplying portion having a supplying opening that is configured to supply a liquid to the liquid consuming apparatus;

a containing portion fluidically communicated with the supplying portion, the containing portion containing the liquid, the containing portion having a flexible sheet material, the containing portion having a first side portion and a bottom portion positioned at a bottom of the containing portion, a lower edge portion of the first side portion and a first edge portion of the bottom portion being attached each other to form a first bottom-side sealed portion; and a first rigid member that is made of a material of higher rigidity than the flexible sheet material, the first rigid member being overlapped with at least a part of the first bottom-side sealed portion and at least a part of the first side portion other than the first bottom-side sealed portion.

2. The liquid container according to claim 1, the first rigid member including a plate-like member which is adhered to the at least a part of the first bottom-side sealed portion and the at least a part of the first side portion other than the first bottom-side sealed portion.

3. The liquid container according to claim 1, the containing portion further having a second side portion positioned at an opposite side of the first side portion, a lower edge portion of the second side portion and a second edge portion of the bottom portion being attached each other to form a second bottom-side sealed portion, the liquid container further comprising:

a second rigid member that is made of a material of higher rigidity than the flexible sheet material, the second rigid member being overlapped with at least a part of the second bottom-side sealed portion and at least a part of the second side portion other than the second bottom-side sealed portion.

4. The liquid container according to claim 3, the bottom portion having a first fold line positioned between the first bottom-side sealed portion and the second bottom-side sealed portion, a folding edge at the first fold line pointing inwardly into the containing portion.

5. The liquid container according to claim 1, the containing portion further having an upper portion positioned at a top of the containing portion, an upper edge portion of the first side portion and a first edge portion of the upper portion being attached to each other to form a first upper-side sealed portion, an upper edge portion of the second side portion and a second edge portion of the upper portion being attached to each other to form a second upper-side sealed portion.

6. The liquid container according to claim 5, the upper portion having a second fold line positioned between the first upper-side sealed portion and the second upper-side sealed portion, a folding edge at the second fold line pointing inwardly into the containing portion.

7. The liquid container according to claim 6, an upper edge portion of the first rigid member configured to be positioned at a place in proximity to the second fold line in a state that the upper portion is folded on the second fold line.

8. The liquid container according to claim 5, a part of the first rigid member configured to be overlapped with at least a part of the first upper-side sealed portion.

9. The liquid container according to claim 6, an upper edge portion of the first rigid member configured to be positioned at a place upper than the second fold line and lower than the first upper-side sealed portion in a state that the upper portion is folded on the second fold line.

10. The liquid container according to claim 1, the first side portion having a flat portion with the containing portion in a state that the liquid container is filled with the liquid, the first rigid member being situated on the flat portion.

11. A liquid container comprising:

a liquid container pouch having a first flexible sheet, a second flexible sheet and a lower gusseted portion, a first part of the lower gusseted portion being attached to a lower part of the first flexible sheet to form a first lower sealed portion, a second part of the lower gusseted portion being attached to a lower part of the second flexible sheet to form a second lower sealed portion;

a liquid outlet member positioned between the first flexible sheet and the second flexible sheet to permit extraction of a liquid contained in the liquid container pouch to a liquid consuming apparatus;

a first regulating member composed of a plate-like member of higher rigidity than the first and second flexible sheets, the first regulating member being overlapped with and adhered to the first lower sealed portion and the first flexible sheet other than the first lower sealed portion;

a second regulating member composed of a plate-like member of higher rigidity than the first and second flexible sheets, the second regulating member being overlapped with and adhered to the second lower sealed portion and the second flexible sheet other than the second lower sealed portion.

12. The liquid container according to claim 11, the lower gusseted portion having a first fold line that is formed between the first and second lower sealed portions, a folding edge at the first fold line pointing inwardly into the liquid container pouch.

13. The liquid container according to claim 11, the liquid container pouch including an upper gusseted portion, a first part of the upper gusseted portion being attached to an upper part of the first flexible sheet to form a first upper sealed portion, a second part of the upper gusseted portion being attached to an upper part of the second flexible sheet to form a second upper sealed portion.

14. The liquid container according to claim 13, the upper gusseted portion having a second fold line that is formed between the first and second upper sealed portions, a folding edge at the second fold line pointing inwardly into the liquid container pouch.

15. The liquid container according to claim 14, each upper edge of the first and second regulating members arranged in proximity to the second fold line in a state that the upper gusseted portion is folded on the second fold line.

16. The liquid container according to claim 14, each upper edge of the first and second regulating members configured to be positioned at a place upper than the second fold line and lower than both of the first and second upper sealed portions in a state that the upper gusseted portion is folded on the second fold line.

* * * * *